United States Patent [19]

Bleickert et al.

[11] Patent Number: 4,915,010

[45] Date of Patent: Apr. 10, 1990

[54] BARRELED WEAPON WITH REGENERATIVE PROPELLANT INJECTION

[75] Inventors: Sonke Bleickert, Ruckersdorf; Gunther Lochner, Altdorf; Klaus Schluter, Erlangen, all of Fed. Rep. of Germany

[73] Assignee: Diehl GmbH & Co., Nuremberg, Fed. Rep. of Germany

[21] Appl. No.: 351,726

[22] Filed: May 15, 1989

[30] Foreign Application Priority Data

May 17, 1988 [DE] Fed. Rep. of Germany ..... 3816663

[51] Int. Cl.[4] ..... F41F 1/04

[52] U.S. Cl. ..... 89/7

[58] Field of Search ..... 89/7

[56] References Cited

U.S. PATENT DOCUMENTS

| | | | |
|---|---|---|---|
| 2,981,153 | 4/1961 | Wilson et al. | 89/7 |
| 4,050,348 | 9/1977 | Graham | 89/7 |
| 4,100,836 | 7/1978 | Hofmann | 89/7 |
| 4,281,582 | 8/1981 | Jagua | 89/7 |
| 4,341,147 | 7/1982 | Mayer | 89/7 |
| 4,523,508 | 6/1985 | Mayer et al. | 89/7 |
| 4,603,615 | 8/1986 | Ashley | 89/7 |
| 4,693,165 | 9/1987 | Magoon et al. | 89/7 |
| 4,711,153 | 12/1987 | Bulman | 89/7 |

*Primary Examiner*—David H. Brown

*Attorney, Agent, or Firm*—Scully, Scott, Murphy & Presser .

[57] ABSTRACT

A barreled weapon with regenerative propellant injection through the intermediary of at least one axially displaceable piston. A ring-shaped or annular cylindrical space is arranged coaxially about the weapon barrel, in effect, about the projectile or shell chamber, in which space there are arranged two mutually oppositely located, opposingly movable annular or ring pistons, whose piston shafts presently divide the space which is available behind the piston head into two selectively interconnectable loading chambers, each piston head possessing passageways which extend from the loading chambers and connect into the end surfaces of the piston heads, which are arranged offset relative to each other in such a manner so as to mutually seal off upon contacting of the oppositely located end surfaces of the piston heads.

10 Claims, 4 Drawing Sheets

BARRELED WEAPON WITH REGENERATIVE PROPELLANT INJECTION

BACKGROUND OF THE INVENTION

1. Field of the Invention

The present invention relates to a barreled weapon with regenerative propellant injection through the intermediary of at least one axially displaceable piston.

2. Discussion of the Prior Art

From the disclosure of German Patent No. 31 53 053 C2 there is already presently known a liquid propellant artillery arrangement utilizing direct injection. This arrangement possesses a breech bore on the breech housing, in which a differential pressure piston is arranged so as to be axially movable. The head of the differential pressure piston is arranged in the breech housing so as to extend towards the end of the weapon barrel. The breech bore is arranged in a combustion chamber at the artillery barrel end of the breech housing, and is divided into a ring-shaped or annular propellant reservoir which encompasses the shaft of the differential pressure piston. Through the intermediary of a separate control piston there is regulated the injection of propellant into the axial breech bore. For the reloading of a projectile, the control piston is relatively displaceable within the differential pressure piston and removable. The propellant injection is implemented through radial and axial passageways arranged within the differential pressure piston, and which stand in communication with the combustion chamber at the end of the weapon barrel.

The construction of the arrangement for the injection of propellant is complex and requires a separate control for the control piston and for the differential pressure piston which are movable relative to each other. Moreover, this arrangement is not adapted for injection of two propellant media which are to be admixed with each other; for example, a fuel and an oxidizer, which comes into application in the employment of diergoles.

SUMMARY OF THE INVENTION

Accordingly, it is an object of the present invention to provide a barreled weapon of the abovementioned type which permits for the utilization of a diergolic as well as a monergolic propellant system, and which evidences an outstanding dynamic action at a relatively small requirement for space and which is for a simple construction.

The foregoing object is inventively attained in that a ring-shaped or annular cylindrical space is arranged coaxially about the weapon barrel, in effect, about the projectile or shell chamber, in which space there are arranged two mutually oppositely located, opposingly movable annular or ring pistons, whose piston shafts presently divide the space which is available behind the piston head into two selectively interconnectable loading chambers, each piston head possessing passageways which extend from the loading chambers and connect into the end surfaces of the piston heads, which are arranged offset relative to each other in such a manner so as to mutually seal off upon contacting of the oppositely located end surfaces of the piston heads and, finally, wherein radial break-throughs are provided in the cylinder wall facing towards the projectile chamber within the region of the contacting plane for the two end surfaces of the piston heads. Hereby, the entire through-passing surface of the break-throughs can be at least equal in size to the cross-sectional surface of the projectile chamber.

Pursuant to a specific embodiment of the invention, the piston stroke of the oppositely located annular pistons can be selectively either of the same or different lengths. Furthermore, the loading chambers can be bounded radially inwardly by the cylindrical wall which extends about the projectile chamber and radially outwardly of the weapon housing or, in essence, the breech housing, and axially bounded by seal or gasket bearers, which concurrently incorporate the inlet passageways for the propellant and the venting passageways.

In order to be able to effect a good braking for the annular pistons towards the end of a piston stroke, the annular pistons can include steps at their inner and outer transitions from, respectively, the piston head to the piston shaft, which enter into correspondingly shaped complementary contours in the rearward seal bearers.

The braking action is hereby based on the throttling effect of the displacement-dependent, reduced-size nozzle entry opening. The particular advantage of the selected arrangement is the utilization of the entire piston surface facing towards the loading chamber as an effective braking surface, whereby the load acting on the annular piston is significantly lowered during this procedure, and the two interconnected chambers which form the projectile chamber are connected with each other through balancing holes in the seal bearer and/or through grooves in the region of the steps. For this purpose, the inlet passageways leading to the nozzles can extend from the steps and connect to the end surface of the piston head.

The projectile chamber can be formed by a caliber component which forms the cylindrical space for the annular piston between its outer mantle surface and the weapon housing, and at each of the respective two end surfaces thereof is provided with a sealing ring with which the caliber component has the end surface thereof contacting against insert pieces which are fixedly introduceable into the weapon housing. The one surface of the caliber component is hereby subjected to the pressure reigning in the weapon barrel. The axial loading of the caliber component, whose critical region is at the connectors between the break-throughs, is extensively reduced by subjecting one of the end surfaces of the caliber component to the gas pressure which is present from the weapon barrel so as to vary from a tensile load through a compressive load.

Finally, the oppositely located end surfaces of the annular piston can be imparted a structured surface, such as knurling, flutings, annular grooves or the like, and the infeed passageways can connect into nozzles which are inserted in a tight fit or form-fittingly into recesses provided on the end surfaces of the piston end head. For instance, the fastening can be effected through the screwing in of the nozzles into the recesses. The nozzles consist of a nozzle insert with nozzle bores which have an extremely small diameter, and which are distributed across the surface of the nozzle insert.

A barreled weapon for the regenerative injection of propellant which is equipped with these features possesses a series of advantages. Thus for one, there can be employed single-component or two-component propellant systems (diergolic, monergolic).

The annular pistons for the regenerative propellant injection which are located opposite each other can possess a differing as well as identical piston stroke. Because of dynamic reasons, and in order to minimize the constructional volume, a symmetrical arrangement of the annular pistons is particularly advantageous. Thereby, at a small constructional volume, there is achieved a good distribution of the greatest possible quantity of propellant at the smallest possible inner diameter for the housing and at a preset piston stroke. The annular piston shaft of each annular piston divides the available charging space behind the annular piston into two part spaces which are connected with each other, or can also be constructed so as to be separated from each other. The subdivision of the propellant components into the four resultant charging spaces can hereby be undertaken selectively, and in an especially advantageous configuration, as follows:

(a) the first propellant component is arranged behind the first annular piston and the second propellant component is arranged completely behind the second annular piston, or (b) the first propellant component is arranged in both outer charging spaces behind the two annular pistons and the second propellant component is introduced into the two inner charging spaces of the two annular pistons, or (c) the volumetric ratio of the propellant components are undertaken in such manner in a special distribution of the two propellant components; for instance, that in three charging spaces of the annular piston there is present the first propellant component and in only one charging space of one annular piston is there present the second propellant component.

This type of construction allows for different distribution ratios for the propellant.

By means of the annular pistons which run oppositely into each other there is also achieved that the injection of the jets from the propellant is in opposite directions, and thereby affords in the zone of the nozzles or injection, a good through-mixing and combustion of the utilized propellant. The combustion gases are conducted through specially selected cutouts in the caliber component into the projectile chamber. Finally, the dynamic behavior of two opposingly running annular pistons is also more expedient, inasmuch as the impulse is eliminated for two relatively large oppositely accelerated masses, whereas for example, at the use of only one piston in one working direction, there can be encountered more extensive dynamic problems.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION OF THE PREFERRED EMBODIMENTS

Figure 1:
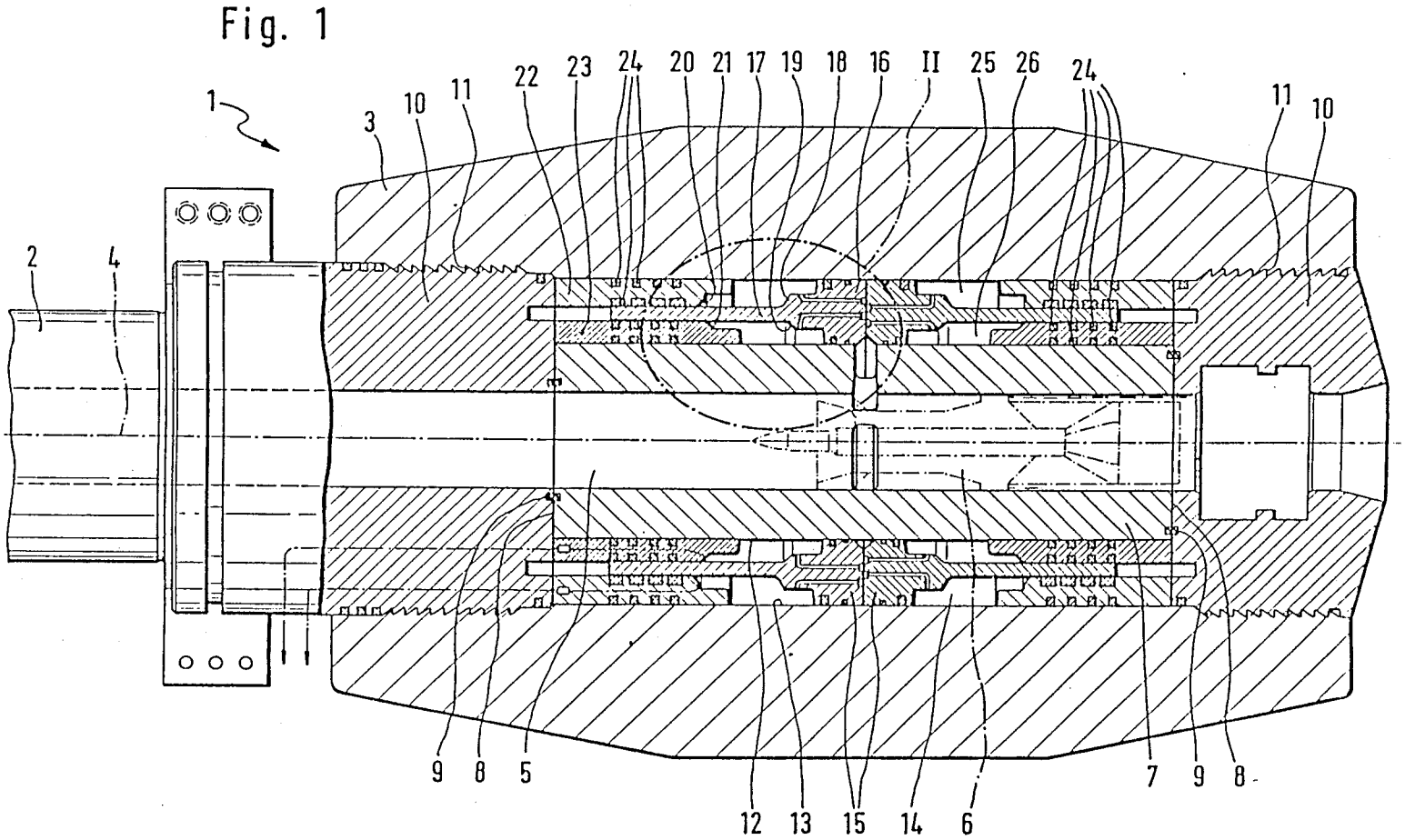
FIG. 1 illustrates a longitudinal sectional view through the weapon housing of a barreled weapon for regenerative propellant injection with two opposingly directed annular pistons.

The barreled weapon 1 possesses a weapon housing or casing 3 at the rear end of the weapon barrel 2. Within the weapon housing 3 there is arranged the projectile chamber 5 coaxially with the bore axis 4, into which chamber there is introduced a projectile 6 which is in readiness for firing. The projectile chamber 5 is formed by a cylindrical caliber component 7 which has its end surfaces 8, with the interposition of a sealing ring 9, contacting against insert pieces 10 which axially contact against the caliber component 7. These insert pieces 10 are positively or tightly interconnected with the weapon housing 3 by means of a screw fastening 11.

Intermediate the outer mantle surface 12 of the caliber component 7 and the inner mantle surface 13 of the weapon housing 3 there is formed an annular cylindrical space 14, into which there are axially movably introduced two facing and oppositely directed annular pistons 15.

Figure 3:
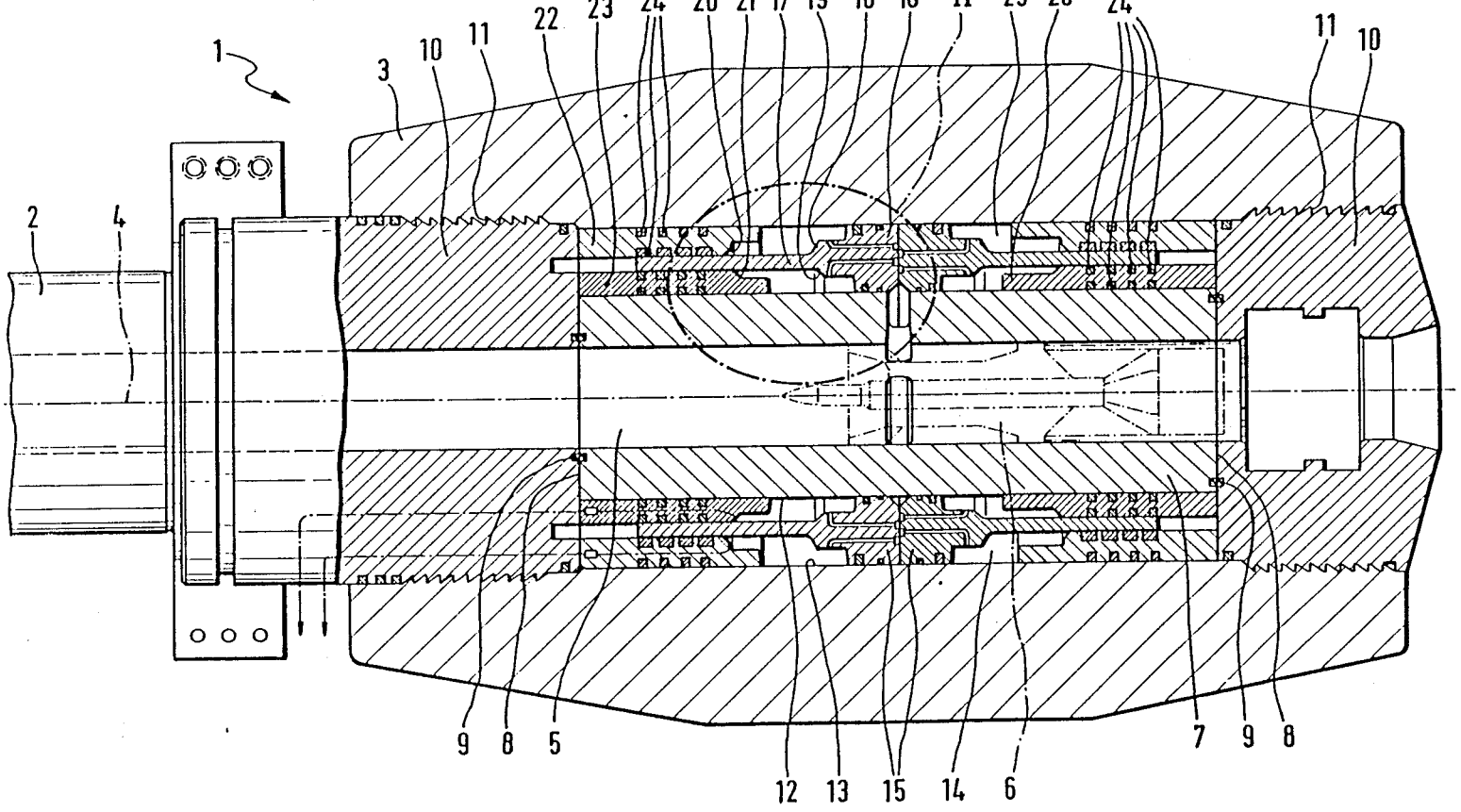
FIG. 3 illustrates an alternate embodiment of FIG. 1.

The length of the stroke for each of these annular pistons 15 is identical to each other, as seen in FIG. 1, or selectively may be of a different displacement as seen for piston A in FIG. 3. The annular pistons 15 each possess a piston head 16 and a piston shaft 17, whereby the regions in the transitions between the piston head 16 to the piston shaft 17 possess steps 18 and 19 at the radially inwardly and radially outwardly located side, which enter into corresponding recesses 20 and 21 of seal carriers 22 and 23 during the rearward contact. The seal carriers 22 and 23 are sleeves which are arranged on the inside and on the outside of the piston shafts 17 and in annular grooves therein and, incorporate sealing elements 24; for instance, piston rings or seal rings. In this manner, there is achieved a radial sealing off of the charging spaces 25 and 26 behind the piston head 16 with regard to the piston shafts 17.

Inlet or supply passageways 28 and 29 extend from the end surfaces 27 of the annular piston heads 16, which passageways communicate with the charging spaces 25 and 26 in the region of the steps 18 and 19. The inlet passageways 28 and 29 possess recesses at the end surface 27 of the piston head, into which nozzles 40 are positioned. The nozzles are equipped with nozzle inserts 41, into which there are introduced a multiplicity of miniature-sized nozzle bores 42. These nozzles 40 are so spaced relative to each other in the annular piston, such that upon contacting of the end surfaces 27 of the annular pistons, pursuant to the illustrated position in FIGS. 1 and 2, the nozzle bores 42 are sealed off. Further balancing bores 30 and 31 are arranged in the seal carriers 22 and 23, which extend from generally the end surfaces thereof into the charging spaces 25 and 26, and then connect into the regions of transition 32 and 33. Instead of the balancing bores there can also be provided grooves 45 at the steps 18, 19 on the piston shaft 17. Special sealings are effected by seal rings 34 and 35 which are arranged on the piston head 16.

Figure 4:
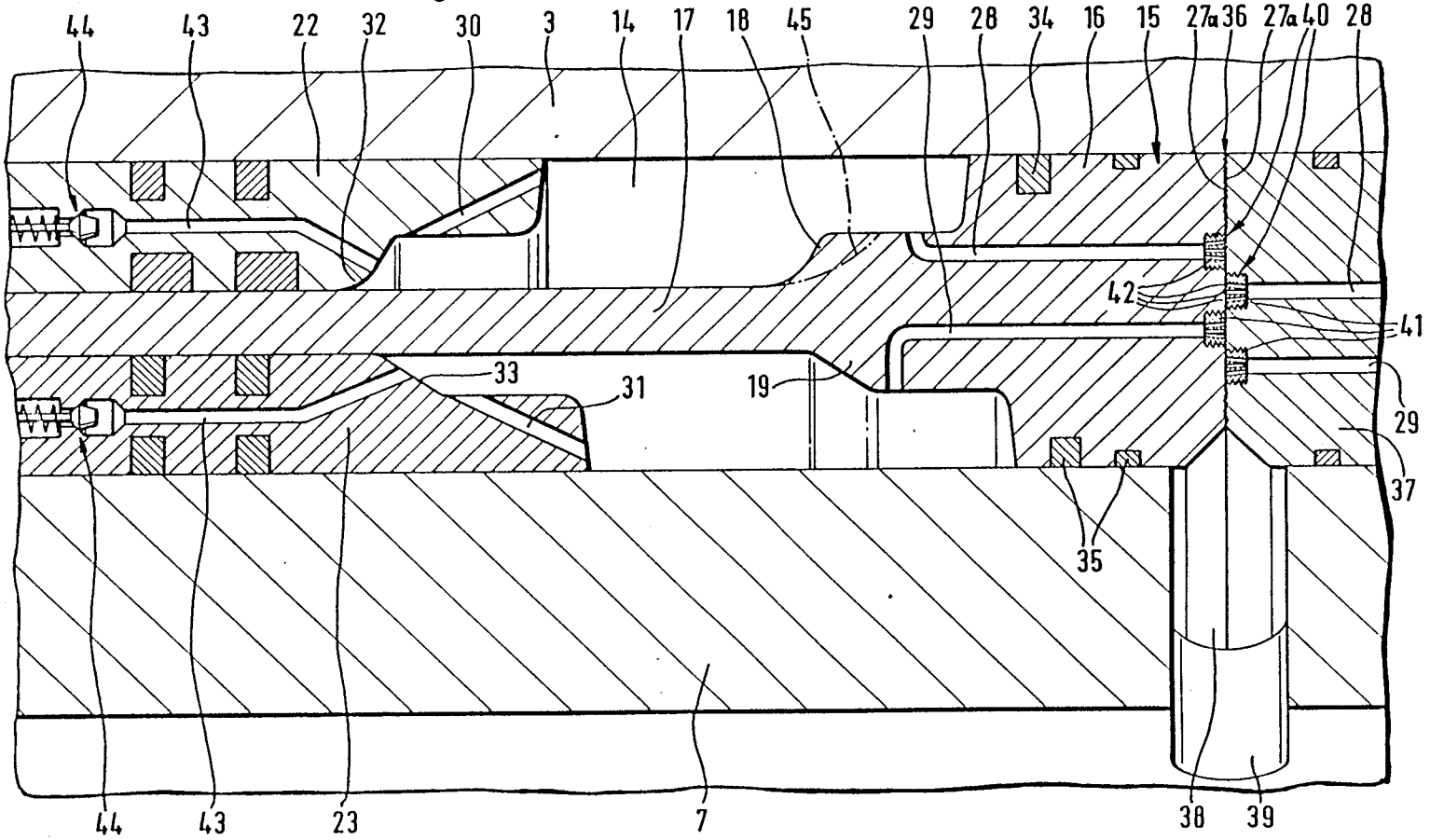
FIG. 4 illustrates an alternate embodiment of FIG. 2.

As been seen in FIG. 4, surfaces 27*a* may have structured or knurled surfaces if desired.

In the region of the plane of contact 36 between the two end surfaces 27 of the piston heads, radial breakthroughs 38 are provided in the cylinder wall of the caliber component 7, or in essence, in the projectile chamber 5, the through-extending surfaces of which are at least equal to the cross-sectional surfaces of the projectile chamber 5. The annular encompassingly arranged breakthroughs 38 are presently separated from each other by means of connectors or spacers 39.

Figure 2:
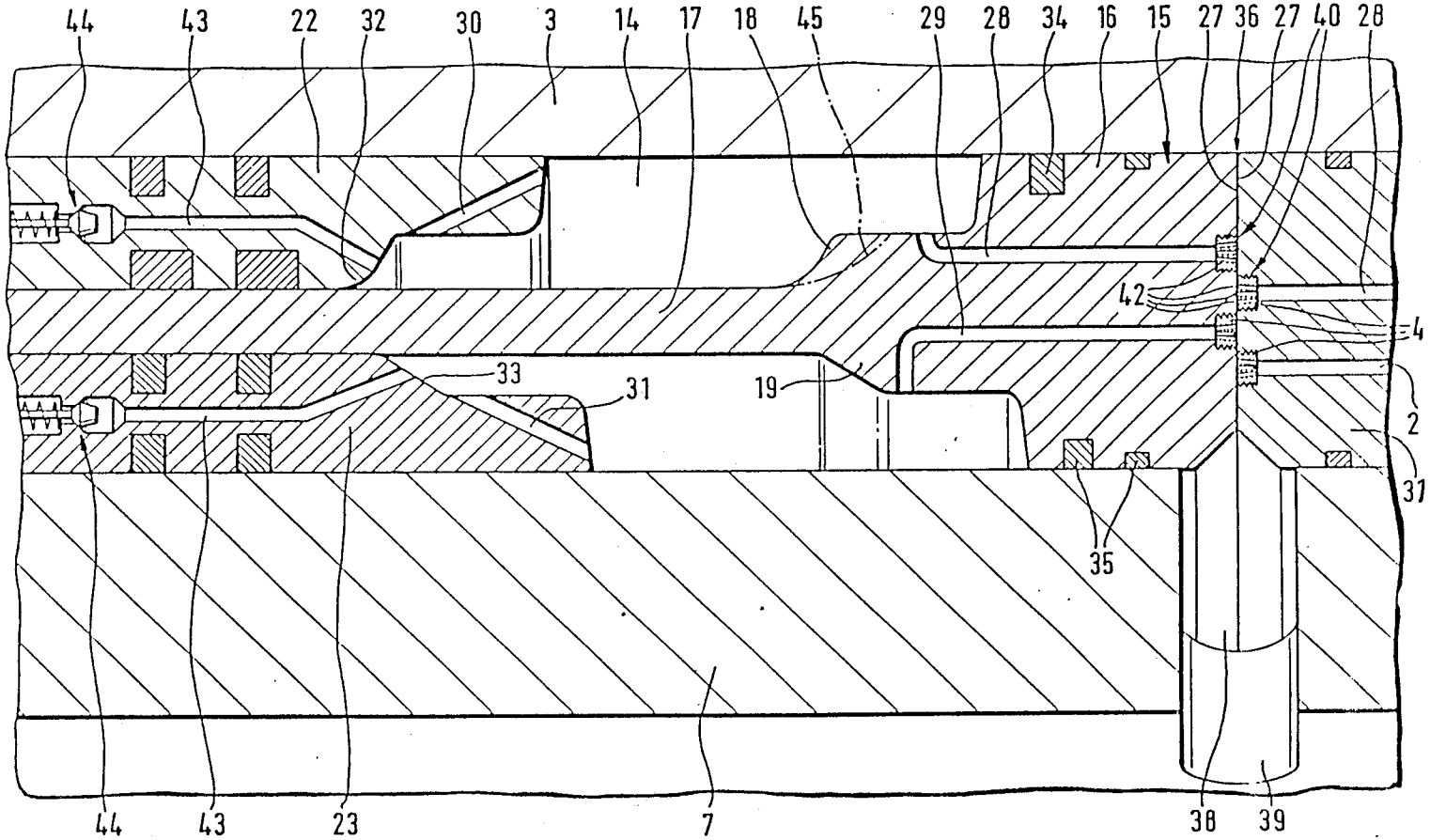
FIG. 2 illustrates, on an enlarged scale, a fragmentary section of an annular piston taken in the encircled portion II in FIG. 1.

At a concurrently effected movement of the opposingly arranged annular pistons 15 from the position shown in FIGS. 1 and 2, the piston heads 16 pass through the charging spaces 25 and 26 and enter into the recesses 20 and 21 in the seal carriers 22 and 23.

Through the arrangement of balancing bores 30 and 31 in the seal carriers 22 and 23, there is achieved an equilibrium in pressure during the rearward movement of the annular pistons 15. The passageways 28 and 29 produce a braking effect in the steps 18, 19 on the annular pistons 15. During the outward movement of the annular pistons in a direction away from each other the propellant which is present in the charging spaces 25 and 26 is injected through the passageways 28 and 29 into the space between the end surfaces 27 of the two annular pistons. Through this oppositely directed injection there is obtained a good preparation of the mixture in the requisite combustion chamber. The combustion products (gas) are pressed through the breakthroughs 38 into the projectile chamber 5 during the outward movement of the two annular pistons 15. Upon a suitable ignition of this propellant mixture through an electrical triggering or through a primary mixture, the projectile 6 which is located in the projectile chamber 5 is driven into the weapon barrel 2 and then fired. In front of the annular pistons 15 the combusting of the propellant mixture already takes place, which mixture is filled into the charging spaces 25, 26 through the inlet passageways 43 with inserted valves 44.

The annular piston shafts 17 divide the available charging space behind the piston head 16 into two charging spaces 25 and 26 which can be constructed so as to be either interconnected or also separated from each other. The subdivision of the propellant components into the thereby possibly obtained four charging spaces 25, 25 and 26,26 can be differently implemented. Presently with the utilization of diergoles, the possibility is existent that the one propellant component; for example, an oxidizer, is to be introduced behind the piston head 16 of the right annular piston 15 and the second propellant component, for example, a fuel, behind the second piston head 16 of the left annular piston 15. On the other hand, it is possible to introduce the first propellant component into the two outward charging spaces 25,25 and second propellant component into two inward charging spaces 26,26.

Furthermore, there is also existent the possibility of dividing the charging spaces in such a manner in conformance with the volumetric relationships or ratios between the propellant components, that the first propellant component is arranged in three charging spaces, and the second propellant component in only one charging space. This selective possibility finally signifies that there can also be employed large ratios in volume of oxidizer to fuel. The achieved braking effect by means of the balancing bores 30 and 31 which are introduced in the seal carriers 22 and 23, afford the advantage of being able to utilize the entire piston surface facing towards the charging space as an effective braking surface, as a result of which the load acting on the annular pistons 15 is significantly reduced during the braking sequence.

What is claimed is:

1. Barreled weapon with regenerative propellant injection; comprising an annular cylindrical space extending coaxially about the barrel of said weapon and about a projectile chamber formed in a cylindrical wall component; two facing and oppositely moveable annular pistons being located in said cylindrical space, said annular pistons each having a piston shaft dividing space available rearwardly of a piston head into two selectively interconnectable charging spaces, each said piston head including passageways extending from the charging spaces and connecting with the end surfaces of the piston head, said passageways being spaced relative to each other so as to be sealed off upon contacting the oppositely located end surfaces of the piston heads, and radial break-throughs being formed in the cylinder component wall facing towards the projectile chamber in the region of the contacting plane of said oppositely located end surfaces of the pistons heads.

2. Barreled weapon as claimed in claim 1, wherein the through-extending surface of the breakthroughs is equal in size to the cross-sectional surface of the projectile chamber.

3. Barreled weapon as claimed in claim 1, wherein the piston stroke of the oppositely located annular pistons is equal.

4. Barreled weapon as claimed in claim 1, wherein said projectile chamber comprises a caliber component forming the cylindrical space for the annular pistons between the outer mantle surface thereof and a weapon housing; and a sealing ring at each of the two opposite end surfaces thereof with which the caliber component has end surfaces contacting insert pieces forming part of the weapon barrel which are fixedly introduceable into the weapon housing.

5. Barreled Weapon as claimed in claim 1, comprising means for imparting piston strokes of different lengths to said oppositely located annular pistons.

6. Barreled weapon as claimed in claim 1, wherein the charging spaces are bounded inwardly by the cylinder component wall about the projectile chamber and radially outwardly by the weapon housing and axially towards rearward regions by seal carriers; said seal carrier concurrently incorporating inlet passageways for propellant and venting passageways.

7. Barreled weapon as claimed in claim 6, wherein the annular pistons include steps at their inner and outer regions of transitions from the piston head to the piston shaft, said steps entering into correspondingly shaped complementary contours in the rearward seal carriers.

8. Barreled weapon as claimed in claim 5, wherein the inlet passageways extend from said steps to nozzles positioned on the end surfaces of the piston heads, and balancing bores extending from the end surfaces of the seal carriers and radially connecting into the mantle surface facing towards the piston shaft.

9. Barreled weapon as claimed in claim 8, wherein the opposite end surfaces of the annular pistons each possess a structured surface in the regions externally of said nozzles.

10. Barreled weapon as claimed in claim 6, wherein said nozzles are inserted in a tight fit in recesses on the end surfaces on the piston head, said nozzles having nozzles bores therein.

* * * * *